United States Patent [19]

Philip

[11] 4,230,307

[45] Oct. 28, 1980

[54] COOLING APPARATUS FOR COPPER CONVERTER OPENING

[75] Inventor: Thomas P. Philip, Nababeep, South Africa

[73] Assignee: O'Okiep Copper Company Limited, Nababeep, South Africa

[21] Appl. No.: 944,699

[22] Filed: Sep. 22, 1978

[30] Foreign Application Priority Data

Sep. 26, 1977 [GB] United Kingdom ..... 40057/77

[51] Int. Cl.[3] ..... C21B 7/10

[52] U.S. Cl. ..... 266/46; 266/190; 266/191; 266/241; 432/237

[58] Field of Search ..... 266/46, 190, 191, 193, 266/241; 432/1, 233, 237; 165/101, 107

[56] References Cited

U.S. PATENT DOCUMENTS

| | | | |
|---|---|---|---|
| 2,424,535 | 7/1947 | Hyland | 266/241 |
| 2,671,658 | 3/1954 | Moore | 165/101 |
| 2,805,851 | 9/1957 | Becker et al. | 266/46 |
| 3,588,072 | 6/1971 | Matsumoto et al. | 266/241 |
| 3,652,070 | 3/1972 | Sagara | 266/46 |
| 3,687,436 | 8/1972 | Wortman | 266/241 |
| 3,693,708 | 9/1972 | Andoniev et al. | 266/193 |
| 3,719,355 | 3/1973 | Suette | 266/241 |
| 3,799,524 | 3/1974 | Menu | 266/241 |
| 3,817,744 | 6/1974 | Leroy et al. | 266/46 |
| 3,818,870 | 6/1974 | Andoniev et al. | 266/193 |
| 3,895,783 | 7/1975 | Fisher | 266/241 |
| 3,963,223 | 6/1976 | Eysn | 266/241 |
| 3,995,687 | 12/1976 | Euler | 266/190 |
| 4,026,352 | 5/1977 | Andoniev et al. | 165/101 |

*Primary Examiner*—L. Dewayne Rutledge
*Assistant Examiner*—John P. Sheehan

[57] ABSTRACT

A cooling device for a converter opening, such as a Peirce-Smith copper converter, has been disclosed wherein a cooling medium, which is a combustible liquid of high temperature cracking characteristics, is introduced in cooling conduits floatingly disposed in a refractory material lining an opening of a converter, through which, at high temperatures, the contents thereof are discharged. The lower vapor pressure of the cooling medium, the expansion and contraction of the conduit in individual cooling segments and the maintaining of the cooling medium under pressure improves the operation of the converter.

5 Claims, 3 Drawing Figures

COOLING APPARATUS FOR COPPER CONVERTER OPENING

This invention relates to furnaces in which the contents are at high temperature and these contents are emptied such as by pouring through an opening.

As background, the following U.S. Pat. Nos. have been considered: 3,588,072; 3,687,436; 3,719,355; 3,799,524; 3,895,783; 4,026,352; and 3,963,223.

According to the invention, there is provided a furnace having a mouth provided with cooling tubes through which a cooling medium can pass, the tubes being in heat exchange contact with fins provided in cooperation with the lining, and means for passing a cooling medium through the tubes.

The furnace cooling includes, in combination, a recycle system comprised of a heat exchanger for cooling the cooling medium that has been used to cool the mouth and means for controlling the recycle. The furnace may preferably be provided with several cooling tubes for cooling the mouth and a suitable pump may be used as the means for passing the cooling medium through the tubes.

A preferred cooling medium is a liquid which is non-explosive if leakage in the cooling conduits occurs. The liquid may, for example, be an oil having a high cracking temperature, e.g., a cracking temperature within a range associated with Mobiltherm 603.

The present invention also extends to a method of cooling further at least part of a furnace lining, but particularly a furnace mouth, which comprises passing a combustible, but high cracking temperature cooling medium, such as oil, through cooling tubes in heat exchange contact with part of the lining, feeding the cooling medium away from the lining and through a heat exchanger to cool it, and returning the cooled cooling medium to the cooling tubes. Suitable pressure control means, e.g., pressure responsive valves, are provided for the cooling medium being fed to the high temperature zone being cooled as well as the cooling medium leaving the high temperature zone.

Thus, the cooling medium which has passed through the heat exchanger is to be supplied to a header tank, e.g., a manifold, and then to a plurality of cooling tubes fitted to the furnace lining and is to be returned from the cooling tubes through a second header tank. A function of the header tanks is to allow for surges in the cooling system and another function is to impose a certain pressure on the cooling medium. The cooling medium may be fed by any suitable pump.

The cooling tubes, which may be square tubes, are preferably arranged between fins welded onto the lining or disposed within the refractory in such a way that the tubes are free to expand and contract with variations of temperature in the lining, i.e., refractory or metal, without cracking. This means that the tubes will not normally be attached to the fins or to the lining.

An embodiment of the invention will now be described, by way of example, with reference to the accompanying drawings, in which.

Figure 1:
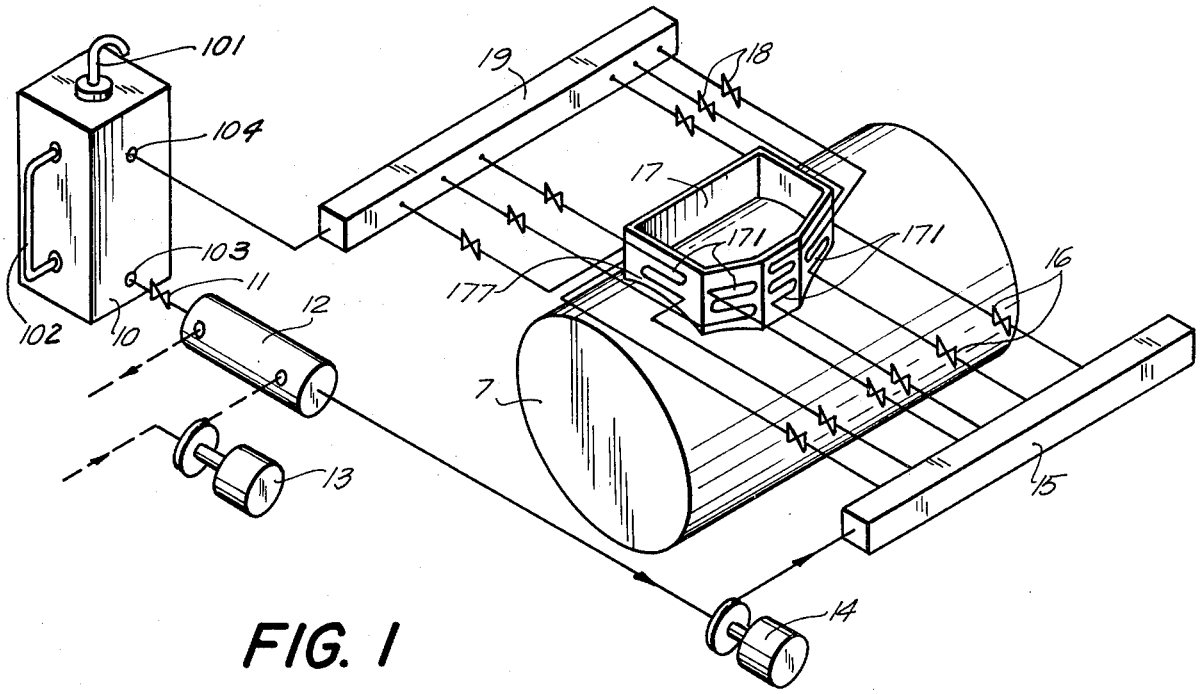
FIG. 1 shows a schematic illustration of a cooling system applied to a converter mouth.

As shown in FIG. 1, a cooling system includes a storage tank 10, in which is stored an oil, preferably having a high cracking temperature, such as Mobiltherm 603. This cooling fluid is also of a type having a low vapor pressure at a high temperature, i.e., the fluid is not likely to vaporize under high thermal load such as when compared to water at the same conditions. The tank is provided with a vent 101 in a conventional manner. A sight glass 102 is also provided for indicating the level of oil in the tank.

An outlet 103 of the tank 10 is connected to control valve 11 and then to an inlet (not shown) of a heat exchanger 12. The oil passes through the heat exchanger 12 and is cooled by water circulating within the heat exchanger. The water is supplied to the heat exchanger by a pump 13.

Oil is drawn from the heat exchanger by a pump 14 which then supplies the oil to a header tank 15, in the form of a suitable manifold. The pump 14 forces oil through the header tank 15 and through suitable control valves 16, i.e., pressure responsive valves, the pressure being adjusted in response to the downstream pressure (from valve 16) to a converter 7 having a mouth 17 therefor, the oil passing into cooling tubes 171 which are in contact with the converter mouth 17. The converter 7 is emptied by partial rotation of its contents.

Having passed through the cooling tubes 171, the oil leaves the converter mouth 17 and travels through control valves 18 into an outlet header 19. These valves are pressure responsive valves, but responsive to the pressure upstream, these valves may also be temperature responsive. From the outlet header 19, the oil is returned to the tank 10 through an inlet 104 thereof, and if needed, an appropriate valve (not shown) may be used therebetween.

The valves also enable individual parts of the cooling system to be isolated such as by a fail safe setting in the event of breakage or other failure.

Figure 2:
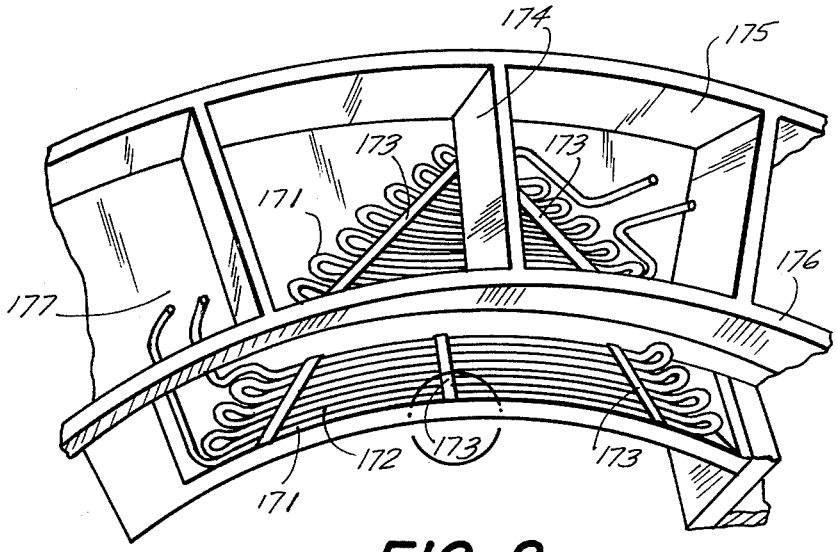
FIG. 2 shows in a perspective, break-out view, an arrangement of cooling tubes in the part of the converter mouth.

In FIG. 2, the outer rim of the converter opening 17 is indicated as 175 and the inner rim as 176. Webs 174 join them together. It is noted that the mouth 17 and the converter 7 are joined in a compound curve and for ease of illustration, only a break-out section of the converter mouth 17 has been shown.

FIG. 2 illustrates some of the cooling tubes 171 mounted on the side of the converter mouth shown in FIG. 1 as 177, all the refractory material being omitted. However, it is to be understood that the refractory material is disposed beneath flange 176. The mouth 17 in this case is the mouth of a Pierce-Smith copper converter. Although only two cooling tubes are shown, it will be appreciated that other tubes are mounted around the converter mouth in a similar manner.

As shown in FIG. 2, the cooling tubes 171 are disposed between contact fins 172, which are themselves welded to steel sections of that part of the mouth that is to be protected such as mouth side parts 177, but if necessary around the entire mouth 17. The tubes are trapped in position by locating elements 173, which, in turn, are attached to the fins 172. This arrangement allows the tubes 171 to contact the fins 172 and to provide adequate heat exchange and also allows the tubes to expand and contract freely without the possibility of cracking. The tubes may be small diameter, e.g., stainless steel tubes, having an internal diameter, for example of $\frac{3}{8}''$.

Figure 3:
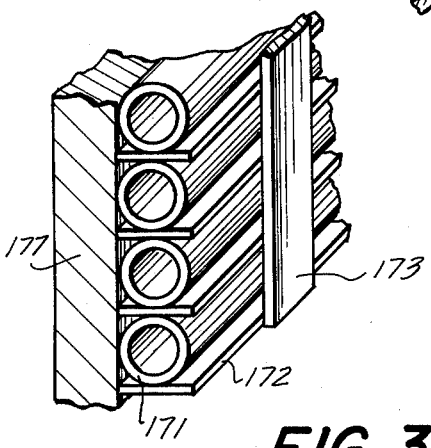
FIG. 3 illustrates an arrangement of cooling tubes, the fins therefor and positioning elements in the circled section shown in FIG. 2.

In FIG. 3, a section through the circled section (shown in FIG. 2) details the attachment of the fins 172 to mouth side 177, and the locating elements 173.

The specific form of the invention described can be used wherever steel or other metal is exposed to high temperature chemical and physical attack, particularly in furnaces which contain molten mattes, metals or slags.

Where the invention is applied to the converter mouth, as described, erosion of the mouth can be reduced and this can result in considerable savings. For example, the number of converter mouths to be built or repaired is reduced, there is a prolonged, useful life-cycle of a converter in those instances where the converter mouth life is determinant and, since the mouth is undamaged at the end of the converter life cycle, it need not be removed and replaced and therefore the adjacent refractories need not be removed to facilitate removal of the mouth. There is thus a refractory saving when the converter is rebuilt, i.e., with fresh refractories.

Still further, the header tanks 15 and 19 in combination with individual valving for each of the tube arrays alleviate surges, prevent "flash choking" of fluids in the tube when rapid heat transfer occurs therein and the fluid vaporizes in whole or in part, etc. However, in combination with the above, a fluid such as the above mentioned Mobiltherm 603 aids the thermal control achievable by the present device by maintaining the liquid's physical properties at relatively high temperatures.

In addition to cooling the mouth, the cooling coils also cool the refractory adjacent to the mouth and the cooler refractories have a longer life than those which are not cooled, e.g., chemical attack is less likely to occur. Liquid contents of the converter which splash onto the mouth and freeze there are more easily removed from the cold surface. Furthermore, in those applications for furnaces which presently employ water-cooling, a change to the described method of cooling makes the operation far safer as regards personnel and equipment, since the danger of explosions as a result of water coming into contact with molten metal or matte, commonly associated with water jackets, is removed.

The above-described oil, "Mobiltherm 603", is a solvent refined paraffinic neutral oil of a specific gravity of 0.865, a SUS viscosity of 105 at 100° F., and a flash point of 380° F.

What is claimed is:

1. In a method for cooling a mouth of a converter through which contents of said converter are discharged at high temperature, the improvement comprising:

maintaining in a storage zone as a cooling medium a combustible liquid of high temperature cracking characteristics;

cooling said cooling medium;

introducing said cooled cooling medium in a first header zone maintained at a preselected temperature or pressure;

selectively admitting said cooled cooling medium, to a plurality of individually segmented zones, in conduits in the form of a serpentine pipe exposed to the high temperature and embedded within a refractory material, said zones being disposed in combination with said mouth and said refractory material lining said mouth such that said individually segmented zones may be cooled;

providing for expansion and contraction of said pipe within each segment independently of said refractory material lining said mouth and in heat exchange relationship therewith;

admitting a heated cooling medium to a second header zone from said individually segmented zones, said second header zone being maintained under a predetermined pressure; and introducing said heated cooling medium into said storage zone for recycle of same.

2. The process as defined in claim 1 wherein the individually segmented cooling zones are further surrounded by said refractory material, said refractory material extending into a zone adjacent said mouth and said adjacent zone being cooled as said mouth is being cooled by said cooling medium.

3. The process as defined in claim 1 wherein said pipe is of stainless steel.

4. A cooling device for a converter holding and discharging hot copper contents through an opening thereof at high temperature, the combination comprising a holding vessel for a cooling medium, means for cooling said cooling medium and a first header vessel for a cooled cooling medium, said means for cooling being responsively interconnected to means for pumping said cooled cooling medium to said first header vessel;

means for selectively admitting said cooling medium to a plurality of individually segmented cooling arrays disposed around a periphery of said opening in response to a pressure maintaining means downstream from each of said segmented cooling arrays comprising conduits floatingly disposed within heat exchange fins, and said heat exchange fins restrainingly disposed within a refractory material for said opening;

means for controlling said cooling medium flow in said individually segmented cooling arrays interconnected with said pressure maintaining means and including additional means for maintaining the pressure in a second header vessel;

and means for reintroducing said cooling medium into said holding vessel.

5. The cooling device as defined in claim 4, wherein the individually segmented cooling array comprises stainless steel tubing floatingly disposed in combination with said heat exchange fins.

* * * * *